US005894869A

United States Patent [19]

Mussack

[11] Patent Number: 5,894,869

[45] Date of Patent: Apr. 20, 1999

[54] $CO_2$ CARTRIDGE PRESSURIZATION DEVICE

[75] Inventor: Kevin R. Mussack, Clifton Springs, N.Y.

[73] Assignee: Crosman Corporation, East Bloomfield, N.Y.

[21] Appl. No.: 08/854,562

[22] Filed: May 12, 1997

[51] Int. Cl.[6] ..... B65B 1/04

[52] U.S. Cl. ..... 141/19; 141/329; 222/5; 222/88

[58] Field of Search ..... 141/19, 329, 98; 222/5, 88, 81, 396, 397

[56] References Cited

U.S. PATENT DOCUMENTS

| | | | |
|---|---|---|---|
| Re. 29,457 | 10/1977 | Hastings . | |
| 3,269,598 | 8/1966 | Butters et al. | 222/5 |
| 3,361,298 | 1/1968 | Trumble | 222/5 |
| 3,937,367 | 2/1976 | Hood . | |
| 3,993,245 | 11/1976 | Smith . | |
| 4,087,048 | 5/1978 | Smrt . | |
| 4,155,509 | 5/1979 | Koyama . | |
| 4,632,276 | 12/1986 | Makino | 222/5 |
| 4,867,209 | 9/1989 | Santoiemmo | 141/19 |
| 4,934,543 | 6/1990 | Schmidt | 222/5 |
| 5,203,507 | 4/1993 | Matthews . | |
| 5,307,995 | 5/1994 | Jackson . | |
| 5,320,252 | 6/1994 | Fleming . | |
| 5,390,854 | 2/1995 | Hench . | |
| 5,533,892 | 7/1996 | Long . | |

*Primary Examiner*—Steven O. Douglas

[57] ABSTRACT

A pressurization and regulating device uses a $CO_2$ cartridge for pressurizing a fluid container such as the fuel tank of a gasoline lantern or stove, a garden or lawn sprayer, and the like. The device includes an elongated body having an open end for receiving the cartridge and a cap for forcing the cartridge toward the body. The other end of the body is provided with a fluid outlet opening. An outlet cap is mounted on the second end of the body. A piston is reciprocably mounted in the outlet opening of the body, and a seal on the piston is engageable with a valve seat in the outlet opening for closing the outlet opening. A spring in the outlet cap biases the piston away from the valve seat. An eccentric shaft is rotatably mounted in the outlet cap and engages the piston. The eccentric shaft is rotatable between a first position in which the seal engages the valve seat and a second position in which the spring moves the seal away from the valve seat. The outlet cap includes an internally threaded connector end.

7 Claims, 7 Drawing Sheets

$CO_2$ CARTRIDGE PRESSURIZATION DEVICE

BACKGROUND

This invention relates to a $CO_2$ cartridge pressurization device, and, more particularly, to a pressurization device which includes a shut-off valve, a pressure regulator, and a pressure relief valve.

Many commonly available products include a fluid tank or reservoir which is pressurized in order to force fluid from the tank or reservoir. For example, gasoline lanterns and gasoline stoves include a gasoline fuel tank for supplying fuel to a burner. The tank includes (hand pump for increasing the air pressure within the tank above ambient air pressure. When a fuel valve is opened, the air pressure forces fuel out of the tank.

Similarly, many lawn and garden sprayers include a fluid tank for holding fertilizer, herbicide, weed killer, etc. A hand pump on the tank pressurizes the tank for forcing fluid from the tank when a valve or spray nozzle is opened.

Many other devices for delivering fluid include a fluid tank or reservoir which relies on internal pressure to force fluid from the tank.

SUMMARY OF THE INVENTION

The invention provides a pressurization device for pressurizing fluid tanks automatically without manual pumping. The pressurization device uses a standard $CO_2$ cartridge which contains pressurized carbon dioxide. The cartridge is inserted into a cartridge holder which includes a cap and a body which are screwed together. As the cap is screwed onto the body, the cartridge is pierced. The other end of the body is provided with an outlet opening, and an outlet cap covers the outlet opening. A pressure regulator, an on-off valve, and a pressure relief valve are mounted in the outlet cap. The end of the outlet cap includes a threaded connector for attaching the device to a fluid tank.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
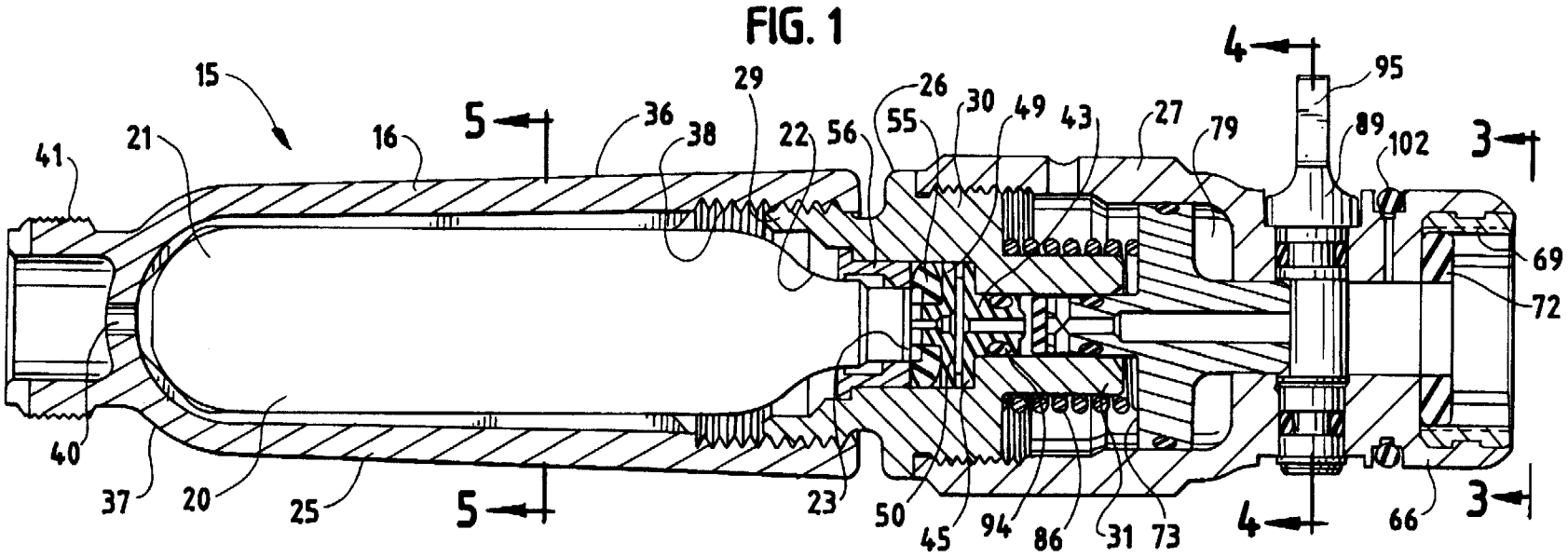
FIG. 1 is a longitudinal sectional view of a pressurization device which is formed in accordance with the invention.

Referring to FIG. 1, the numeral 15 designates generally a pressurization device which includes a cartridge holder 16 for holding a standard $CO_2$ cartridge 17. The $CO_2$ cartridge holds 12 grams of pressurized $CO_2$, which consists of a liquid phase and a gaseous phase. Such cartridges are commonly used in $CO_2$ powered guns and are available from Crosman Corporation of East Bloomfield, N.Y. and other suppliers.

The $CO_2$ cartridge includes a tubular body 20 having a dome-shaped closed end 21 and a necked end 22 which is closed by a cap 23. A pierceable seal is mounted in the cap for retaining the pressurized $CO_2$ within the cartridge until the seal is pierced.

Figure 6:
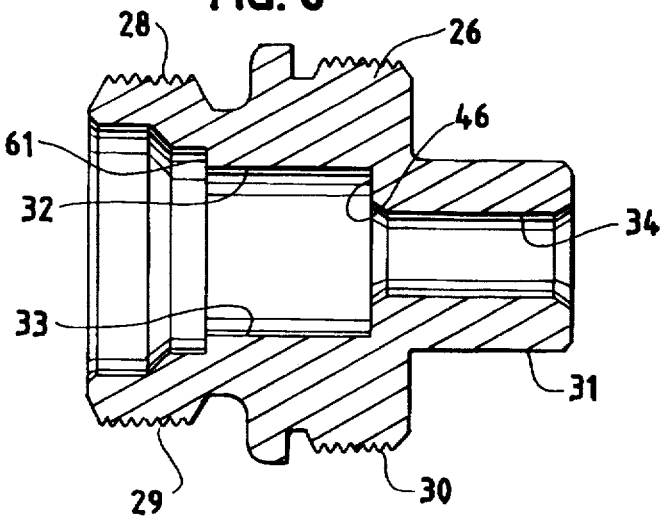
FIG. 6 is a longitudinal sectional view of the body of the cartridge holder.
Figure 7:
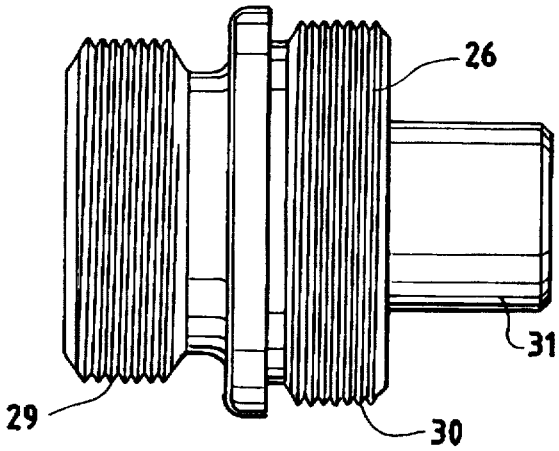
FIG. 7 is a longitudinal plan view of the body.

The cartridge holder 16 includes an elongated tubular cartridge holder cap 25, a body 26, and an outlet cap 27. Referring to FIGS. 6 and 7, the body 26 is generally tubular and includes an outer surface 28 having an externally threaded rear end 29 and an externally threaded intermediate portion 30, and a reduced diameter forward neck portion 31. The body is provided with an internal bore 32 which includes a rear portion 33 and a reduced diameter front portion 34 which extends through the neck 31.

Figure 5:
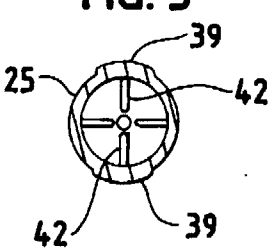
FIG. 5 is a sectional view taken along the line 5—5 of FIG. 1.
Figure 4:
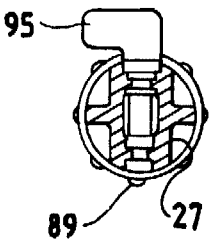
FIG. 4 is a sectional view taken along the line 4—4 of FIG. 1.
Figure 3:
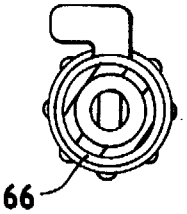
FIG. 3 is an end view taken along the line 3—3 of FIG. 1.
Figure 2:
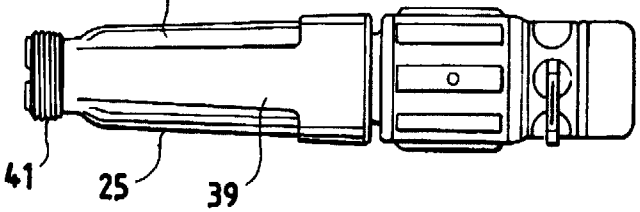
FIG. 2 is a top plan view of the pressurization device.
Figure 17:
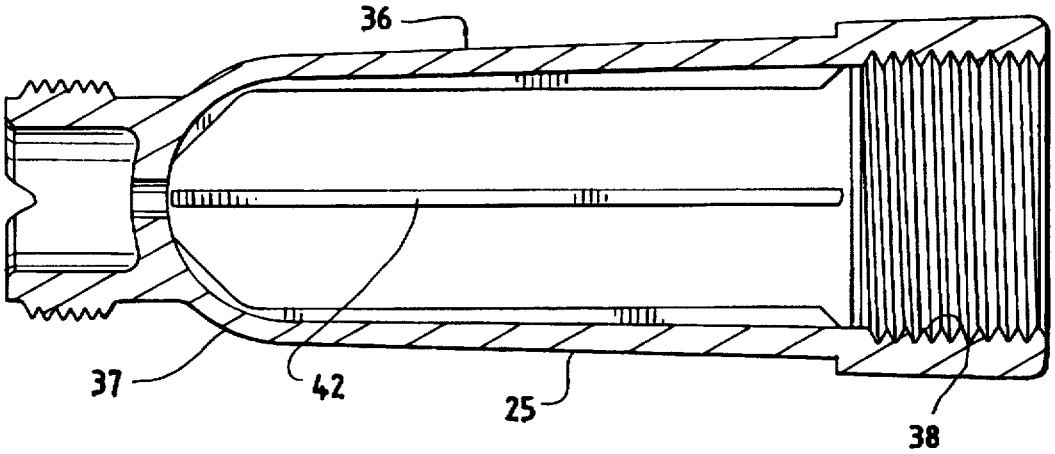
FIG. 17 is a longitudinal sectional view of the elongated tubular cartridge holder cap.

The cap 25 (FIGS. 1, 2, 5, and 17) includes a generally cylindrical but tapered side wall 36 and a rear end wall 37. Internal screw threads 38 adjacent the open front end of the cap mate with the threaded rear end 29 of the body 26. The side wall includes longitudinally extending ribs 39 for facilitating rotation of the cap. A vent opening 40 extends through the end wall 37, and an externally threaded cylindrical extension 41 extends rearwardly from the end wall. The interior surface of the cap includes four longitudinally extending ribs 42 (FIGS. 5 and 17) for centering the $CO_2$ cartridge 17 within the bore of the cap. The cap can be molded from glass reinforced nylon.

Figure 10:
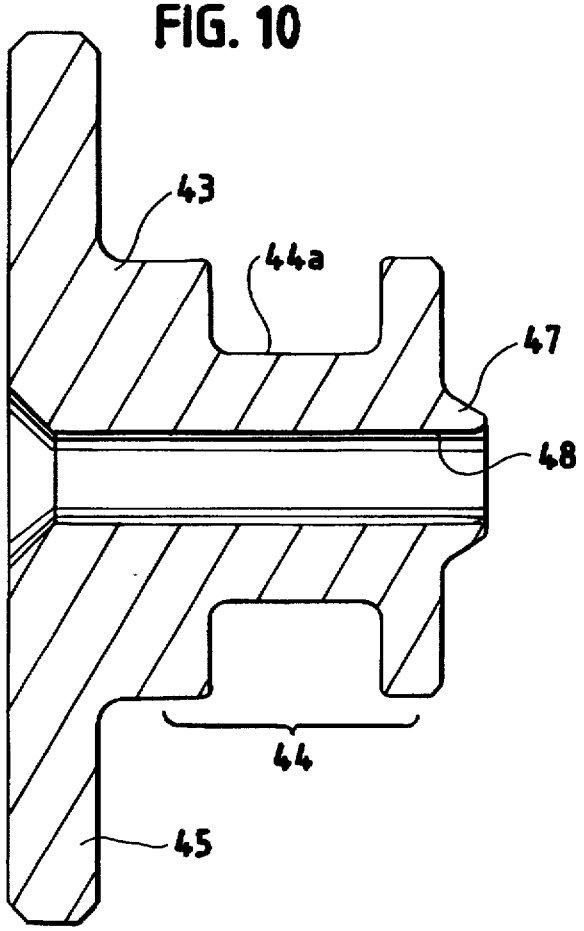
FIG. 10 is a longitudinal sectional view of the valve seat.

A valve seat 43 (see also FIG. 10) is mounted in the bore 32 of the body 26. The valve seat is substantially hat-shaped and includes a cylindrical portion 44 which extends into the front portion 34 of the bore and a radially outwardly extending flange portion 45 which abuts a shoulder 46 (FIG. 6) on the body. The valve seat 43 is preferably sealingly held in place in the bore 31 by an O-ring 94, which is seated in an annular O-ring groove **44*a* of the valve seat. A conical seating ring 47 projects forwardly from the cylindrical portion of the valve seat, and a fluid passage 48** extends axially through the valve seat.

Figure 8:
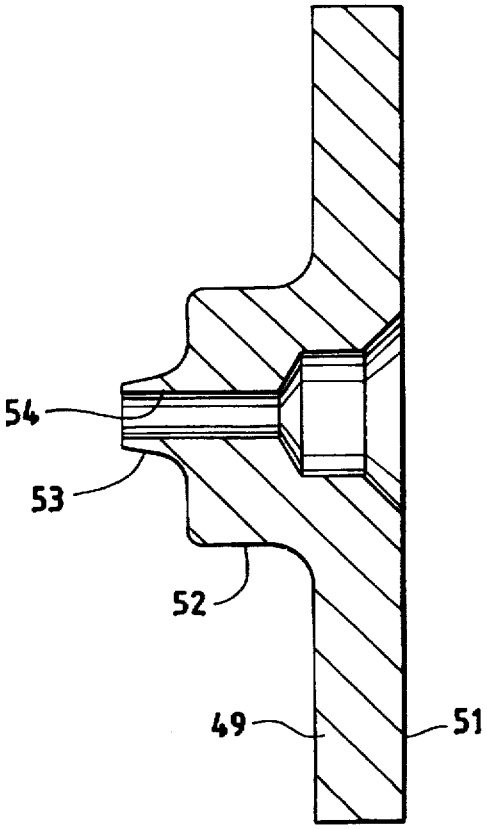
FIG. 8 is a sectional view of the piercing pin.

A piercing pin 49 (see also FIG. 8) is mounted in the rear portion of the bore 32 behind the valve seat, and a screen 50 is positioned between the piercing pin and the valve seat. The piercing pin is similar to piercing pins used in $CO_2$ guns and includes a circular base 51, a cylindrical boss 52, and a tubular projection 53 which terminates in a sharp beveled end. A fluid passage 54 extends through the piercing pin.

Figure 9:
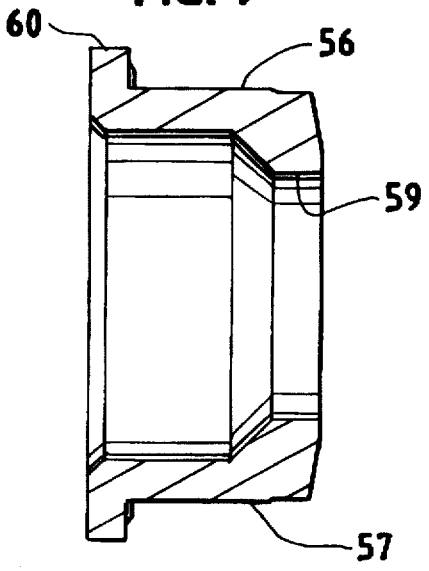
FIG. 9 is a longitudinal sectional view of the guide collar.

A gasket or seal ring 55 is forced against the piercing ring by a guide collar 56 (see also FIG. 9). The guide collar includes a cylindrical side wall 57, a front wall 58 having a central opening 59, and a radially outwardly extending rear flange 60.

The guide collar is forced into the body 26 against the seal ring 55 until the rear flange 60 engages a shoulder 61 (FIG. 6) on the body 26. The guide collar is then secured in place. In the preferred embodiment the body 26 and the guide collar are molded from glass fiber reinforced nylon, and the parts are secured together by ultrasonic welding.

Figure 11:
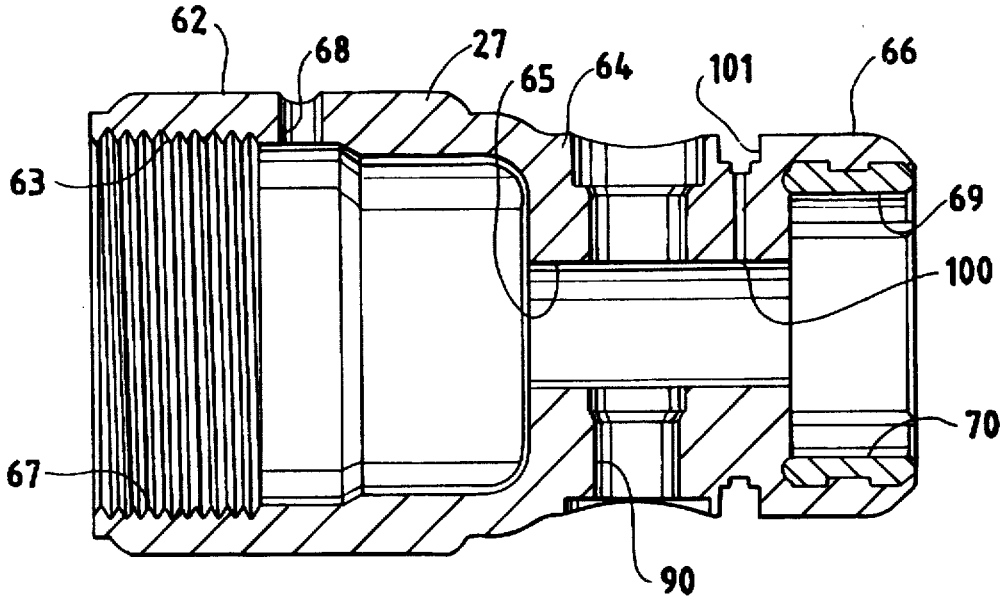
FIG. 11 is a longitudinal sectional view of the outlet cap.
Figure 12:
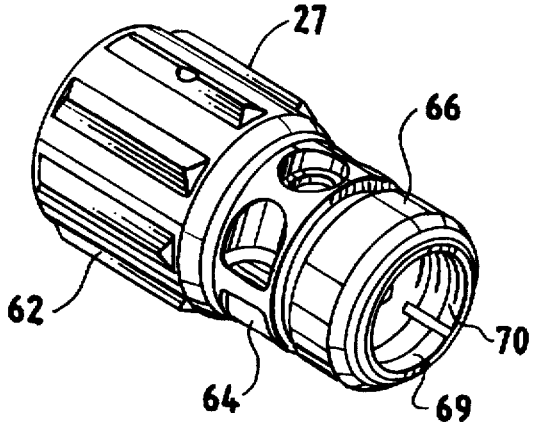
FIG. 12 is a perspective view of the outlet cap.

The tubular outlet cap 27 (See also FIGS. 11 and 12) includes a generally cylindrical rear portion 62 having a bore 63, a central portion 64 having a fluid outlet passage 65, and a forward cylindrical connector portion 66. The cylindrical rear portion includes internal screw threads 66 which mate with the threaded portion 30 on the body 26. A vent opening 68 extends through the rear portion.

Figure 16:
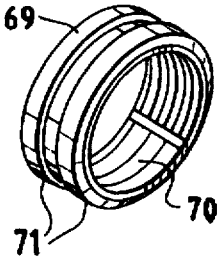
FIG. 16 is a perspective view of the thread insert.

A cylindrical thread insert 69 (see also FIG. 16) is mounted in the connector portion 66. The thread insert is advantageously formed from metal such as brass and includes internal threads 70 and two external knurled bands 71. The knurled bands frictionally engage the inside surface of the connector portion 66 and prevent relative rotation therebetween. The outlet cap 27 may be formed from glass fiber reinforced nylon and can be molded around the thread insert. A gasket or seal ring 72 (FIG. 1) is inserted into the thread insert.

Figure 13:
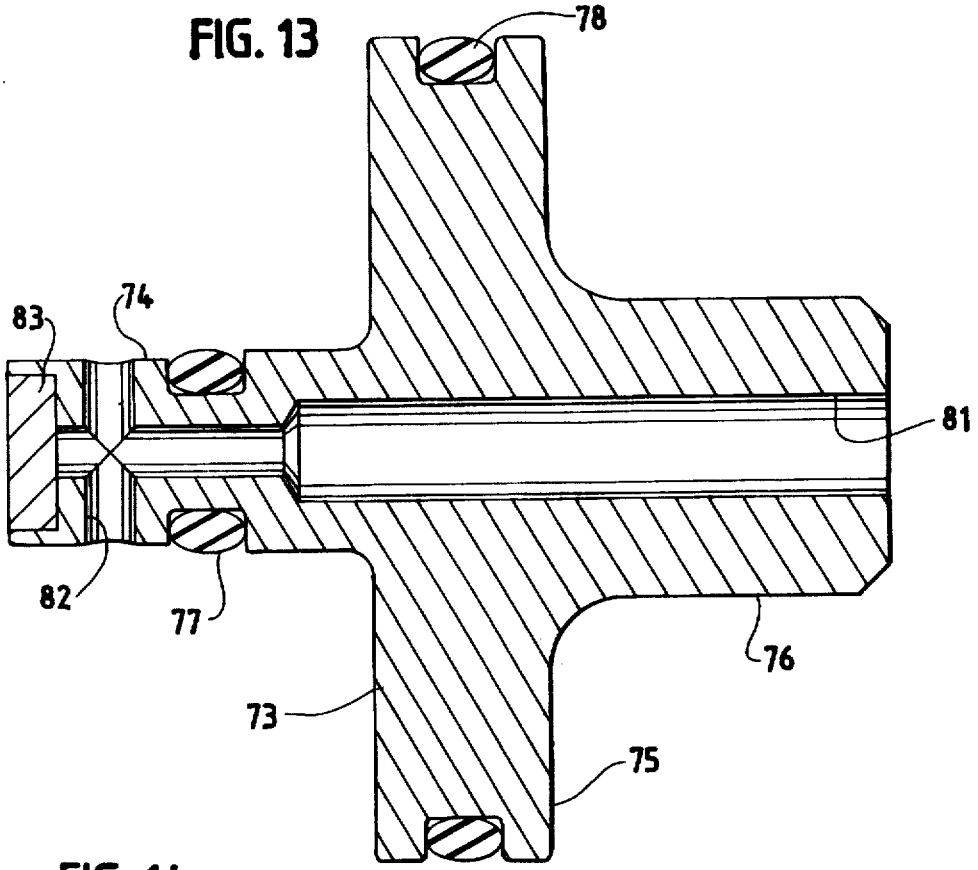
FIG. 13 is a longitudinal sectional view of the piston assembly.
Figure 14:
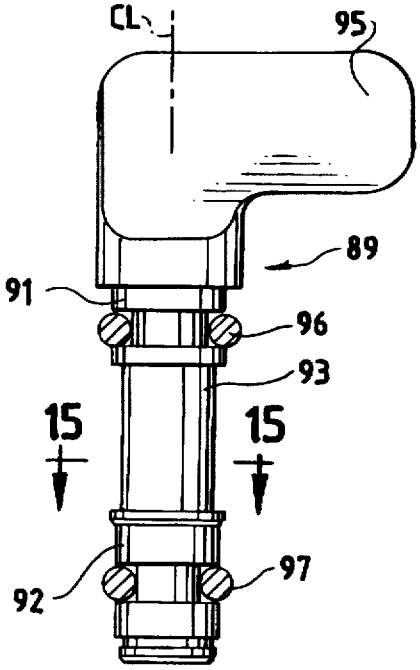
FIG. 14 is a side view of the eccentric shaft.
Figure 15:
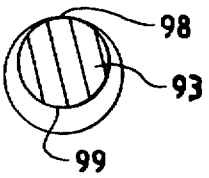
FIG. 15 is a sectional view taken along the line 15—15 of FIG. 14.

A piston 73 (see also FIG. 13) is positioned between the forward end of the body 26 and the outlet cap 27. The piston includes a cylindrical rear end portion 74 which is reciprocably mounted in the necked forward end of the body 26, a radially enlarged cylindrical central portion 75 which is reciprocably mounted in the bore 63 of the outlet cap 27, and a cylindrical forward end portion 76 which is reciprocably mounted in the fluid outlet passage 65 of the outlet cap. An O-ring 77 is mounted in an annular groove in the rear portion 74 for sealingly engaging the inside surface of the necked portion of the body 26. An O-ring 78 is mounted in an annular groove in the central portion 75 for sealingly engaging the wall of the bore 63 of the outlet cap 27. The forward portion 76 of the piston does not sealingly engage the wall of the fluid outlet passage 65, and pressure in the fluid outlet passage communicates with a pressure chamber 79 (FIG. 1) which is formed by the bore 63 of the outlet cap forwardly of the central portion 75 of the piston.

A fluid passage 81 extends longitudinally through the piston, and a cross-bore fluid passage 82 extends radially through the rear end portion 74 rearwardly of the O-ring 77. A resilient and compressible valve seal 83 is mounted in a cylindrical recess of the rear portion 74 and is frictionally retained therein. The piston 73 is resiliently biased forwardly by a spring 86 (FIG. 1) which ensleeves the necked forward end portion 31 of the body 26.

An eccentric or camming shaft 89 (FIGS. 1, 4, 14, and 15) is rotatably mounted in a transverse bore 90 (FIG. 11) which extends through the central portion of the outlet cap 27. The eccentric shaft includes a pair of cylindrical end portions 91 and 92 and an eccentric or camming central portion 93. The upper end of the eccentric shaft includes a handle 95 which extends transversely from the shaft for rotating the shaft 89 within the bore 90. O-rings 96 and 97 are mounted in annular grooves in the end portions 91 and 92 for sealingly engaging the outlet cap 27.

The eccentric portion 93 has a generally cylindrical cross section (FIG. 15) which is offset from the longitudinal centerline CL (FIG. 14) of the shaft 89. The eccentric portion includes a camming surface 98 which is spaced radially farther from the centerline than the diametrically opposite surface 99.

A pressure relief port 100 (FIG. 11) extends radially through the outlet cap forwardly of the eccentric shaft 89 and connects the fluid outlet passage 65 with an annular groove 101 in the outer surface of the outlet cap. An O-ring 102 (FIG. 1) in the groove 101 normally closes the relief port 100 but can be forced outwardly by excess pressure in the fluid outlet passage to relieve excessive pressure within the outlet passage.

Figure 18:
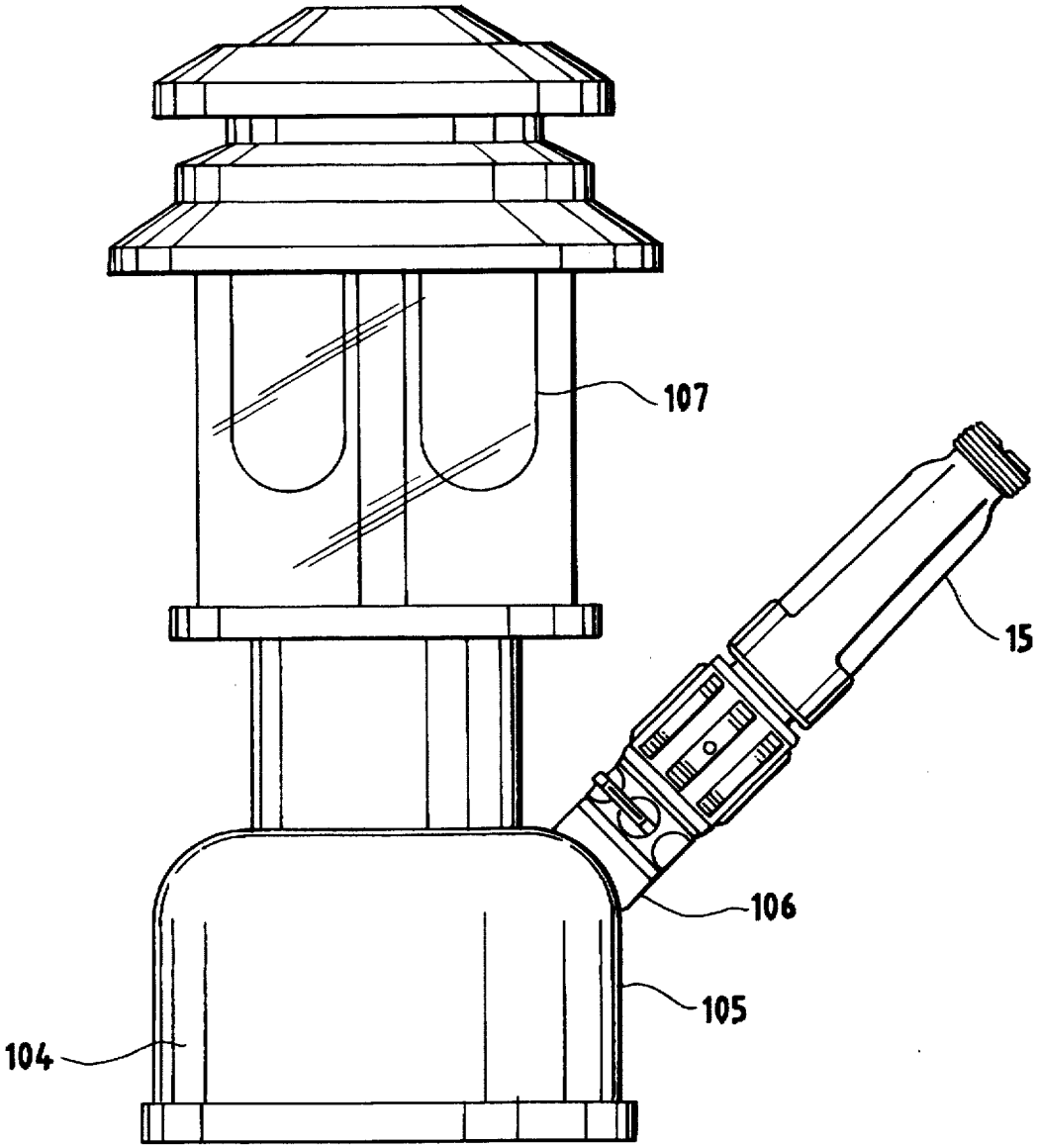
FIG. 18 illustrates the pressurization device attached to a gasoline lantern.

FIG. 18 illustrates the pressurization device 15 connected to a conventional commercially available gasoline lantern 104. Such lanterns are described, for example, in U.S. Pat. Nos. Re. 29,457 and 5,533,892 and include a fuel tank 105 for storing liquid fuel such as unleaded gasoline. The tank includes an externally threaded cylindrical fill spout 106 and a hand pump (not shown in FIG. 18).

In normal operation the air space in the fuel tank above the liquid fuel is pressurized by the hand pump, and when the fuel valve of the lantern is opened, fuel is forced through a dip tube in the fuel tank to a burner assembly 107 where the fuel is ignited.

A fuel tank for a gasoline stove similarly conventionally includes an externally threaded fill spout and a hand pump for pressurizing the air space in the tank.

The pressurization device 15 can be used with the lantern 104 by unscrewing the gas cap from the fill spout 106 and screwing the end connector 62 onto the fill spout. The gas cap be secured onto the threaded rear end 41 of the pressurization device so that the cap will not be misplaced. As will be described hereinafter, the eccentric shaft 89 is then rotated to allow pressurized $CO_2$ to flow into the fuel tank 105.

A full $CO_2$ cartridge 17 is inserted into the cartridge holder 16 by unscrewing the elongated tubular cartridge holder cap 25 and inserting the cartridge into the open rear end of the body 26. The guide collar 56 guides the necked-down end of the cartridge into contact with the seal ring 55. As the cap 25 is screwed onto the body 26, the cap forces the cartridge onto the piercing pin 49, causing the piercing pin to pierce the seal of the cartridge. If the cartridge is to be pierced before the pressurization device is secured to the lantern, the eccentric shaft 89 is rotated to close the on-off valve for the fluid outlet passage 65 which is provided by the valve seat 47 and the valve seal 83. Referring to FIGS. 1, 10, 13, and 14, the eccentric shaft is rotated to cause the camming surface 98 to force the piston 73 to the left so that the valve seal 83 engages the seating ring 47 of the valve seat 43. The outlet end of the bore 29 is thereby closed.

After the end connector 66 is screwed onto the fill spout of the gasoline lantern, the eccentric shaft 89 is rotated to allow the spring 86 to move the piston 73 to the right in FIG. 1 to open the valve 47, 83. Pressurized $CO_2$ fluid flows through the valve seat 43, through the piston 73, and through the outlet cap 27 into the fuel tank.

The piston 73 and spring 86 act as a regulator to regulate the pressure in the fluid outlet passage 65 and in the fuel tank. Pressurized fluid in the fluid outlet passage 65 flows rearwardly around the forward end 76 of the piston and acts against the right face of the central portion 75 of the piston. The left face of the central portion 75 is maintained at ambient atmospheric pressure by the vent opening 68 in the outlet cap 27. As the pressure in the fluid outlet passage 65 increases, the piston is moved to the left against the force of the spring 86 to close the valve seal 83 against the valve seat 47. As the pressure in the fluid outlet passage decreases, the spring 86 forces the piston to move to the right, allowing more $CO_2$ fluid to flow through the fluid outlet passage 65 and into the fuel tank.

The spring force of the spring 86 is selected to provide the desired pressure regulation. In one specific embodiment of a pressurization device for a gasoline lantern, the spring 86 regulated the pressure in the fuel tank to 20±10 psi gauge.

The O-ring 102 which normally seals the vent port 100 in the outlet cap 27 acts as a safety relief valve in the event of excessive pressure build-up. In the foregoing specific embodiment, the resilience and stretch characteristics of the O-ring were such that the O-ring would expand to open the vent portion at a pressure of about 35 to 50 psi gauge.

The amount of $CO_2$ in the cartridge 17 is sufficient to pressurize several fillings of the fuel tank. When it is desired the refill the fuel tank, the pressurization device can be removed from the fill spout of the fuel tank by rotating the eccentric shaft 89 to force the piston 73 toward the valve seat 47 to seal the pressurized $CO_2$ in the valve seat 43 and piercing pin 49. The pressurization device can then be unscrewed from the fill spout. After the fuel tank is refilled, the pressurization device is screwed back onto the fill spout, and the eccentric shaft is rotated to open the valve and pressurize the fuel tank.

When the $CO_2$ cartridge is to be replaced, the cap 25 is unscrewed from the body 26. Before the threads of the end cap are completely disengaged from the threads of the body, the seal between the $CO_2$ cartridge and the sealingly ring 55 is relieved, and any remaining $CO_2$ pressure is vented around the cartridge and through the opening 40 in the cap while the cap is still retained on the body by the threads. After a new cartridge is inserted and the end cap is screwed onto the body, the cartridge sealingly engages the seal ring 55 before the piercing pin pierces the cartridge.

The pressurization device can also be used to pressure other types of fluid tanks or reservoirs, for example, sprayers for spraying liquid fertilizers and herbicides, water sprayers, etc. The pressurization device provides quick and easy pressurization without any manual pumping.

While in the foregoing specification a detailed description of a specific embodiment of the invention was set forth for the purpose of illustration, it will be understood that many of the details herein given can be varied considerably by those skilled in the art without departing from the spirit and scope of the invention.

I claim:

1. A $CO_2$ cartridge pressurization device comprising:

a generally tubular cartridge holder adapted to receive a $CO_2$ cartridge, the cartridge holder having a fluid passage, valve means for opening and closing the fluid passage, the valve means including a valve seat within the cartridge holder, a piston reciprocably mounted in the cartridge holder and having first and second ends and a fluid passage extending therebetween, a valve seal on the first end of the piston, and means for resiliently biasing the piston and the valve seal away from the valve seat, the valve seal being engageable with the valve seat for closing the fluid passage when the pressure in the fluid passage becomes excessive, connecting means on the cartridge holder for connecting the pressurization device to a container to be pressurized, and means for manually moving the valve seal into engagement with the valve seat wherein the fluid passage can be closed manually.

2. The device of claim 1 in which the cartridge holder includes an outer surface which is provided with an annular groove, a fluid port connecting the annular groove and the fluid passage, and an O-ring in the annular groove for normally closing the fluid port and for opening the fluid port when the pressure in the fluid passage becomes excessive.

3. The device of claim 1 in which said manual means includes a shaft which is rotatably mounted in the cartridge holder and extends generally transversely to the fluid passage, the shaft including a camming portion which is engageable with the second end of the piston when the shaft is rotated for forcing the valve seal on the first end of the piston against the valve seat.

4. In combination with a liquid fuel burning appliance having a fuel tank for storing liquid fuel, a $CO_2$ cartridge pressurization device comprising:

a generally tubular cartridge holder adapted to receive a $CO_2$ cartridge, the cartridge holder having a fluid passage, valve means for opening and closing the fluid passage, the valve means including a valve seat within the cartridge holder, a piston reciprocably mounted in the cartridge holder and having first and second ends and a fluid passage extending therebetween, a valve seal on the first end of the piston, and means for resiliently biasing the piston and the valve seal away from the valve seat, the valve seal being engageable with the valve seat for closing the fluid passage when the pressure in the fluid passage becomes excessive, connecting means on the cartridge holder for connecting the pressurization device to the fuel tank, and means for manually moving the valve seal into engagement with the valve seat wherein the fluid passage can be closed manually.

5. The structure of claim 4 in which said fuel burning appliance is a gasoline lantern.

6. The structure of claim 4 in which said manual means includes a shaft which is rotatably mounted in the cartridge holder and extends generally transversely to the fluid passage, the shaft including a camming portion which is engageable with the second end of the piston when the shaft is rotated for forcing the valve seal on the first end of the piston against the valve seat.

7. A method of pressurizing a fuel tank of a liquid fuel burning appliance comprising the steps of:

introducing liquid fuel into the fuel tank, connecting a $CO_2$ cartridge pressurization device to the tank, the cartridge pressurization device comprising a generally tubular cartridge holder adapted to receive a $CO_2$ cartridge, the cartridge holder having a fluid passage, valve means for opening and closing the fluid passage, the valve means including a valve seat within the cartridge holder, a piston reciprocably mounted in the cartridge holder and having first and second ends in a fluid passage extending therebetween, a valve seal on the first end of the piston, and means for resiliently biasing the piston and the valve seal away from the valve seat, the valve seal being engageable with the valve seat for closing the fluid passage when the pressure in the fluid passage becomes excessive, means for manually moving the valve seal into engagement with the valve seat wherein the fluid passage can be closed manually, inserting a $CO_2$ cartridge into the cartridge holder, piercing the $CO_2$ cartridge to release $CO_2$ contained therein to pressurize the fuel tank, operating the means for manually moving the valve seal into engagement with the valve seat to close the fluid passage, disconnecting the cartridge pressurization device from the fuel tank, introducing additional liquid fuel into the fuel tank, reconnecting the cartridge pressurization device to the fuel tank, and operating the means for manually removing the valve seal to move the valve seal out of engagement with the valve seat to open the fluid passage and to pressurize the tank.

* * * * *